US005771688A

United States Patent [19]

Hasegawa et al.

[11] Patent Number: 5,771,688

[45] Date of Patent: Jun. 30, 1998

[54] AIR-FUEL RATIO CONTROL APPARATUS FOR INTERNAL COMBUSTION ENGINES

[75] Inventors: Jun Hasegawa; Hisashi Iida, both of Kariya, Japan

[73] Assignee: Nippondenso Co., Ltd., Kariya, Japan

[21] Appl. No.: 694,176

[22] Filed: Aug. 8, 1996

[30] Foreign Application Priority Data

| | | | |
|---|---|---|---|
| Aug. 29, 1995 | [JP] | Japan | 7-220608 |
| May 31, 1996 | [JP] | Japan | 8-139076 |

[51] Int. Cl.[6] ..... F02D 41/14; F01N 3/20

[52] U.S. Cl. ..... 60/276; 123/676; 123/681

[58] Field of Search ..... 60/276, 285; 123/676, 123/681, 682, 683, 684

[56] References Cited

U.S. PATENT DOCUMENTS

| | | | |
|---|---|---|---|
| 4,528,961 | 7/1985 | Katoh et al. | 123/683 |
| 4,561,403 | 12/1985 | Oyama et al. | 123/676 |
| 4,993,393 | 2/1991 | Hosoda et al. | 123/677 |
| 5,072,712 | 12/1991 | Steinbrenner et al. | 123/684 |
| 5,103,791 | 4/1992 | Tomisawa | 123/681 |
| 5,450,836 | 9/1995 | Kashiwabara | 123/683 |
| 5,507,269 | 4/1996 | Morikawa | 123/684 |

FOREIGN PATENT DOCUMENTS

| | | |
|---|---|---|
| 63-65146 | 3/1988 | Japan . |
| 1-110853 | 4/1989 | Japan . |
| 3-210033 | 9/1991 | Japan . |
| 3-275956 | 12/1991 | Japan . |
| 4-5451 | 1/1992 | Japan . |

*Primary Examiner*—Willis R. Wolfe
*Attorney, Agent, or Firm*—Nixon & Vanderhye P.C.

[57] ABSTRACT

On an exhaust pipe of an internal combustion engine, an A/F sensor is disposed at an upstream side of a three-way catalyst and a downstream side $O_2$ sensor is disposed on a downstream side thereof. A CPU determines according to an exhaust gas temperature whether the operational state of the engine is in a high load. In an early stage of the engine operation of high load, CPU sets a "rich" side target air-fuel ratio within a range that enables the downstream side $O_2$ sensor to make linear detection of air-fuel ratio and executes feedback control of air-fuel ratio by using the set target air-fuel ratio. Also, when the level of the load has increased, CPU sets a "rich" side target air-fuel ratio according to the exhaust gas temperature and executes feedback control of air-fuel ratio by using the set target air-fuel ratio. Further, when the "rich" width deviates from a range that enables the A/F sensor to make its detection, CPU performs open-loop control with respect to the increment in fuel.

11 Claims, 14 Drawing Sheets

(°C)
t1
t2
t4
t5
1000
900
800
700
HEAT RESISTING LIMIT
TK1
TK2
Texh 0.2V
0.45
SO2V t3
0.998
1.0
λTG
λTGMIN 1.0
FAF 14.7
A/F

FOTP
0

AIR-FUEL RATIO CONTROL APPARATUS FOR INTERNAL COMBUSTION ENGINES

BACKGROUND OF THE INVENTION

1. Field of the Invention

The present invention relates to an air-fuel ratio control apparatus for internal combustion engines.

2. Description of the Related Art

In an engine system, when its operational state is in a range of high load (e.g., a range wherein the number of engine rotations=large and the pressure of the intake air=high), the temperature of engine exhaust gas rises, with the result that there is the possibility that the catalyst and sensors that are provided on an exhaust gas passageway may be impaired and deteriorated in performance. As a countermeasure against this, there are disclosed techniques of, during such a high load operation, causing increment in the quantity of the fuel to be injected from a fuel injection valve and thereby causing decrease in the exhaust gas temperature. For example, in an "Air-Fuel Ratio Control Apparatus for Internal Combustion Engines" that is disclosed in Japanese Patent Application Laid-open Publication No. 63-65146, when the exhaust gas temperature has become higher than a preset value, increment in fuel is performed. At this time, at an initial stage, it is arranged to give a large value of fuel increment and thereafter change to a value of fuel increment that is smaller than the initial value. That is, according to this Publication, the decrease in the exhaust gas temperature is intended to be achieved under the severest operational conditions such as those in a state transition from a state of continuation of intermediate load to a high load through acceleration.

Also, in a "Method of Controlling Fuel Supply during High Load Operation of Internal Combustion Engines" that is disclosed in Japanese Patent Application Laid-open Publication No. 3-210033, when the operational state of an engine has entered into a range of high load, it is arranged to set a value of increment in fuel that corresponds to this state of high load and gradually increase the fuel increment value from this set value of increment in fuel up to a final desired value of increment in fuel. That is, according to this Publication, cooling of the engine by increment in fuel is suitably performed in correspondence with the temperature of the engine, whereby the fuel consumption characteristic is improved.

However, in the above-mentioned Publications, although the decrease in the exhaust gas temperature and improvement in the fuel consumption characteristic could be realized by increment in fuel, there is the likelihood that the exhaust emission might become seriously deteriorated as a result of increment in fuel. That is, in each of the above-mentioned Publications, since the fuel injection control (incrementing correction) during high load is performed through open-loop control, there is the likelihood that the purifying performance of the catalyst might decrease with the result that the quantity of HC, CO, etc. exhausted might increase.

SUMMARY OF THE INVENTION

The present invention has an object to provide an air-fuel control apparatus for internal combustion engines which can suppress the deterioration in the exhaust emission to a minimum level while suppressing the rise in the exhaust gas temperature during high load.

According to the present invention, when the operational state of the engine is in a range of high load, the target air-fuel ratio is set to a "rich" side and feedback control (closed-loop control) is performed using this set target air-fuel ratio. As a result of this, it is possible to suppress the deterioration of the exhaust emission to a minimum level while suppressing the rise in the exhaust gas temperature during high load.

Also, in the present invention, during high load, the target air-fuel ratio is set to a "rich" side in correspondence with the level of the load, whereby feedback control of air-fuel ratio is performed using this target air-fuel ratio. Accordingly, it is possible to suppress the deterioration of the exhaust emission to a minimum level while suppressing the rise in the exhaust gas temperature during high load.

Generally, when the increment in fuel during high load is large, the exhaust gas temperature reliably decrease. However, the extent to which the emission is deteriorated increases. Conversely, when the increment in fuel is small, the decrease in the exhaust gas temperature becomes small. However, the deterioration in the emission is suppressed. Therefore, preferably, the target air-fuel ratio is set so that while the rise in the exhaust gas temperature is being suppressed to within a prescribed permissible range the increment in fuel at that point in time may become minimum.

Preferably, an $O_2$ sensor that uses a zirconia element is used for the feedback control. This sensor generates electromotive forces that differ between the "rich" side and "lean" side of the stoichiometric air-fuel ratio as a boundary in correspondence with a difference in oxygen concentration between the atmospheric air side and the exhaust gas side and, in a very small range of air-fuel ratios that are at around the stoichiometric air-fuel ratio, detects the air-fuel ratio linearly and with a high precision. In this case, at an initial stage of the engine operation in a range of high load, a "rich" side target air-fuel ratio is set within a range of air-fuel ratio linearly detectable by the $O_2$ sensor and, on the other hand, in correspondence with a deviation between the detected results of this $O_2$ sensor and the target air-fuel ratio ("rich" side target air-fuel ratio) at that point in time, the target air-fuel ratio is corrected, whereby highly precise air-fuel ratio control at an initial stage in a range of high load can be realized. Also, when the level of the load (exhaust gas temperature) rises with the result that the air-fuel ratio has deviated from the range of air-fuel ratio linearly detectable by the $O_2$ sensor, a "rich" side target air-fuel ratio is set in correspondence with the level of the load, whereby an appropriate air-fuel ratio can be realized even after entry of the engine operation into a range of high load.

Preferably, a linear air-fuel ratio sensor detects an air-fuel ratio within a prescribed range of air-fuel ratios that are at around the stoichiometric air-fuel ratio. For this reason, when a "rich" side target air-fuel ratio goes beyond this prescribed detectable range, feedback control becomes difficult to perform. However, at a point in time that corresponds to this, fuel injection control is transferred to the open-loop control to thereby enable continuous execution of the decrease in the exhaust gas temperature.

Further, preferably, whether the operational state of engine is in a range of high load is determined in correspondence with the exhaust gas temperature. In this case, by determining whether the operational state of engine is in a range of high load by the direct use of the exhaust gas temperature, it is possible to prevent reliably the impairments and performance deterioration of the catalyst and sensors provided on the exhaust gas passageway.

DETAILED DESCRIPTION OF THE PREFERRED EMBODIMENTS (First Embodiment)

A first embodiment wherein the present invention has been embodied with respect to an air-fuel ratio control apparatus for internal combustion engines will now be described.

Figure 1:
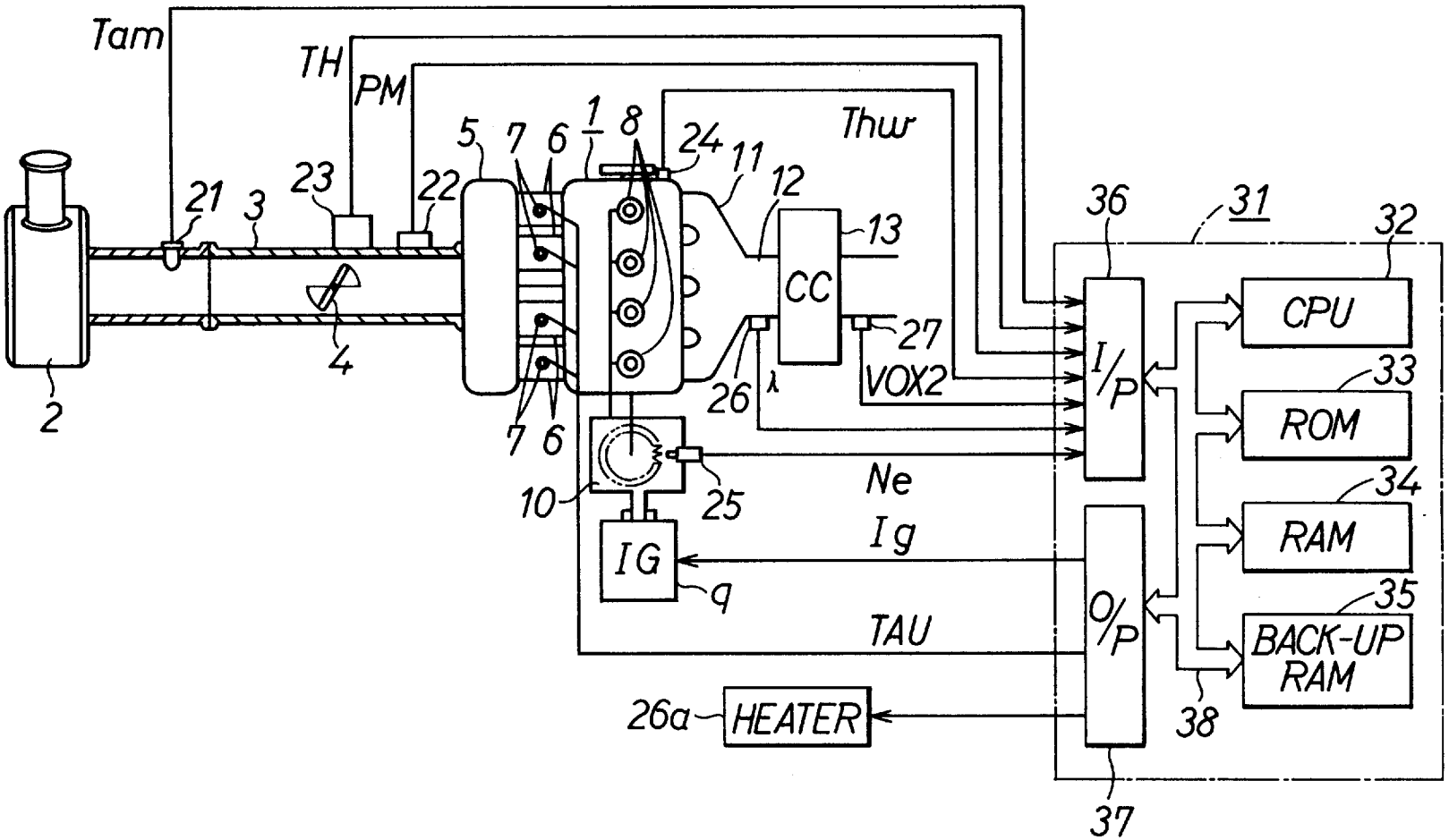
FIG. 1 is a constructional view illustrating an entire air-fuel ratio control apparatus for internal combustion engines in an embodiment of the present invention.

FIG. 1 is a schematic constructional view illustrating an internal combustion engine provided with an air-fuel ratio control apparatus in this embodiment and its peripheral devices. As illustrated in FIG. 1, the internal combustion engine 1 is constructed as an in-line 4-cylinder/4-cycle spark ignition type. The intake air therefor passes, when viewed from the upstream side, through an air cleaner 2, air intake pipe 3, throttle valve 4, surge tank 5 and intake manifolds 6 in that order. Within the intake manifolds 6, the air is mixed with fuel injected from each fuel injection valve 7. Then, the intake air is supplied to each corresponding cylinder as an air-fuel mixture having a prescribed air-fuel ratio.

Also, a high voltage that is supplied from an ignition circuit (IG) 9 is supplied, by being distributed by a distributor 10, to spark plugs 8 provided on respective cylinders of the internal combustion engine 1. Whereby, the spark plug 8 ignites the air-fuel mixture in each air cylinder with a prescribed timing. The exhaust gas after combustion passes through exhaust manifolds 11 and exhaust pipe 12 and has its harmful components (CO, HC, NOX, etc.) to be purified by a three-way catalyst (CC) 13 provided on the exhaust pipe 12 and then is discharged into the atmospheric air.

On the air intake pipe 3 there are provided an intake air temperature sensor 21 and an intake air pressure sensor 22. The intake air temperature sensor 21 detects the temperature of an intake air (intake air temperature Tam) and the intake air pressure sensor 22 detects the pressure of an intake air (intake air pressure PM) downstream from the throttle valve 4. Also, with respect to the throttle valve 4 there is provided a throttle sensor 23 for detecting a degree of opening of the throttle valve 4 (throttle opening TH), which throttle sensor 23 outputs an analog signal that corresponds to the throttle opening TH and, on the other hand, outputs a detection signal indicating that the throttle valve 4 is substantially fully closed. Also, on a cylinder block of the internal combustion engine 1 there is provided a water temperature sensor 24 which is intended to detect the temperature of a cooling water within the internal combustion engine 1 (cooling water temperature Thw). With respect to the distributor 10 there is provided a rotation sensor 25 for detecting the number of rotations (engine speed Ne) of the internal combustion engine 1, which rotation sensor 25 outputs 24 pulse signals at equal angular intervals in two rotations of the internal combustion engine, i.e., 720° CA.

Further, on the exhaust pipe 12 on the upstream side of the three-way catalyst 13 there is provided an A/F sensor 26 (upstream side air-fuel ratio sensor) that consists of a limiting current type oxygen sensor and outputs a wide range of linear air-fuel ratio signals $\lambda$ proportionately to the varying concentration of oxygen in the exhaust gas discharged from the internal combustion engine 1. A heater 26*a* for maintaining the A/F sensor 26 at a temperature at which this sensor 26 is kept activated is equipped to the A/F sensor 26 (in the Figure, the heater 26*a* is illustrated by being separated). The A/F sensor 26 has a diffusion resistance layer on the exterior of a solid electrolyte layer such as zirconia element ($ZrO_2$) and outputs a limiting current signal under a prescribed applied voltage that corresponds to the air-fuel ratio $\lambda$.

Also, on the exhaust pipe 12 on the downstream side of the three-way catalyst 13 there is provided a downstream side $O_2$ sensor 27 (downstream side air-fuel ratio sensor) that outputs a voltage-VOX2 that corresponds to whether the air-fuel ratio is rich or lean with respect to the stoichiometric air-fuel ratio ($\lambda$=1). The downstream side $O_2$ sensor 27 generates an electromotive force that corresponds to a difference in oxygen concentration between the inside and outside of the zirconia element ($ZrO_2$). It is to be noted that although the "air-fuel ratio" usually means a mixing ratio (mass ratio) between air and gasoline, in this embodiment form for convenience sake an excess-of-air rate $\lambda$ (=actual air-fuel ratio/stoichiometric air-fuel ratio) is referred to as an "air-fuel ratio". Therefore, the air-fuel ratio $\lambda=1$ means the stoichiometric air-fuel ratio.

Figure 2:
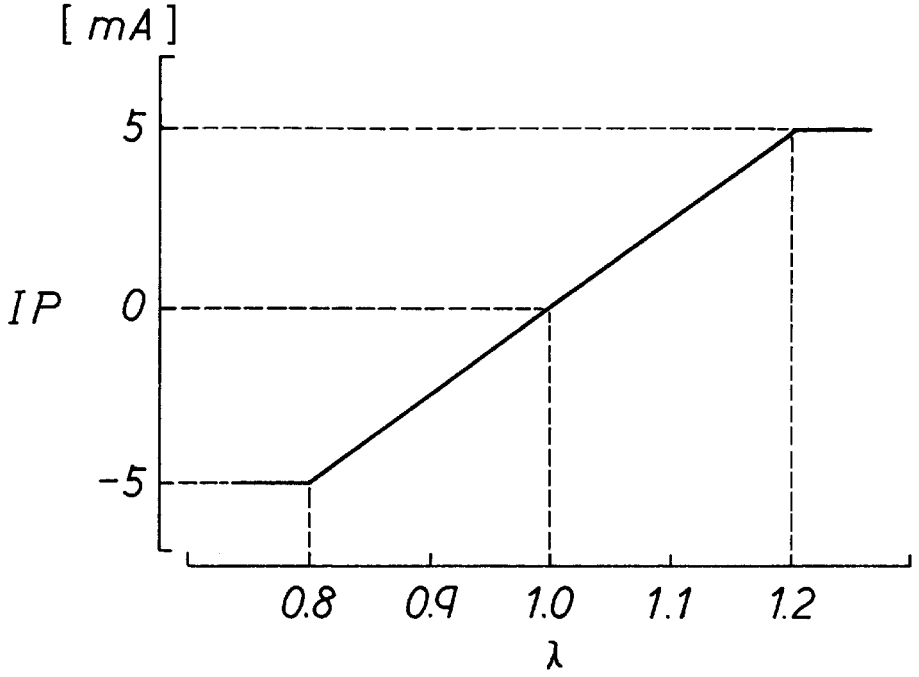
FIG. 2 is a graph illustrating the output characteristic of an A/F sensor.
Figure 3:
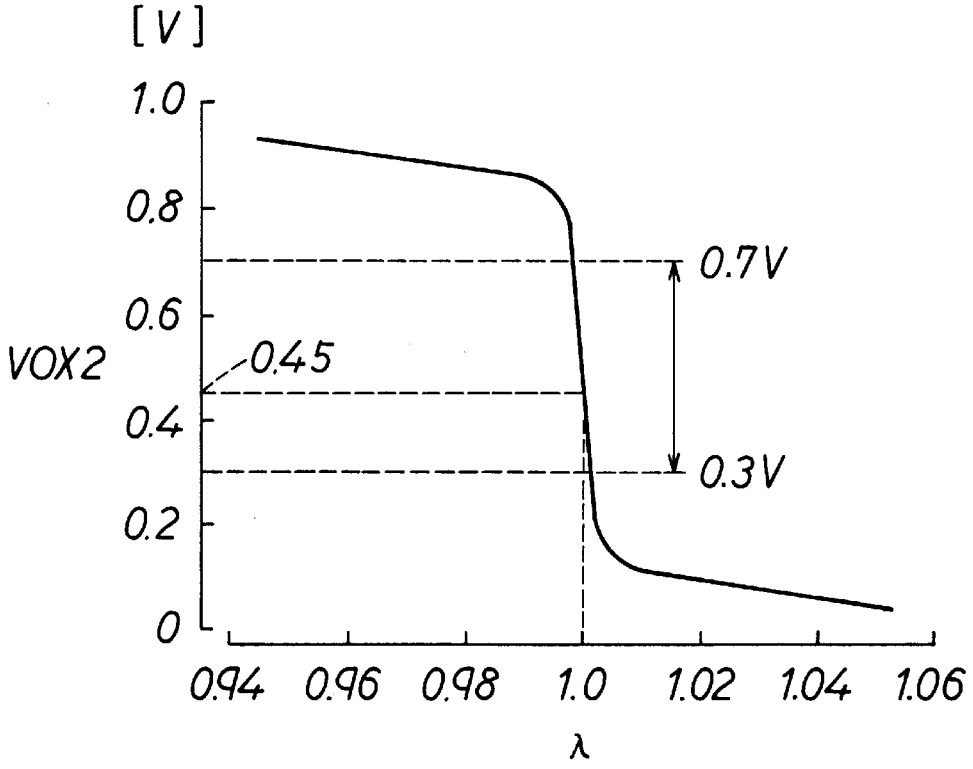
FIG. 3 is a graph illustrating the output characteristic of a downstream side $O_2$ sensor.

The output characteristics of the A/F sensor 26 and downstream side $O_2$ sensor 27 will now be explained. FIG. 2 illustrates the output characteristic of the A/F sensor 26 and FIG. 3 illustrates the output characteristic of the downstream side $O_2$ sensor. Namely, as illustrated in FIG. 2, the A/F sensor 26 outputs a limiting current $I_P$ [mA] that varies linearly in correspondence with the air-fuel ratio $\lambda$ under a prescribed applied voltage. It is to be noted that the range of $\lambda$ detectable by this A/F sensor 26 is from approximately 0.8 to 1.2.

Also, as illustrated in FIG. 3, the downstream side $O_2$ sensoe 27 generates an output voltage VOX2 [V] that varies largely from the stoichiometric air-fuel ratio $\lambda=1$ that is a boundary. At this time, the output voltage VOX2 indicates an electromotive force that corresponds to a difference between the oxygen concentration in the atmospheric air and that in the exhaust gas. The value thereof is a voltage value of approximately 1 V when the air-fuel ratio is on the "rich" side and, when the air-fuel ratio is on the "lean" side, is a voltage value of approximately 0 V. It is to be noted that the downstream side $O_2$ sensor 27 can make linear detection of the air-fuel ratio $\lambda$ in a very small range of air-fuel ratios (0.996 to 1.004) that are only at around the stoichiometric air-fuel ratio $\lambda=1$ (a range wherein the output voltage VOX2 is from approximately 0.3 to 0.7 [V]).

On the other hand, in FIG. 1, an electronic control unit (hereinafter, referred to as "ECU") 31 for controlling the operation of the internal combustion engine 1 is constructed of a logic operation circuit whose main components are CPU (Central Processing Unit) 32, ROM (Read Only Memory) 33, RAM (Random Access Memory) 34, Back-Up RAM 35, etc. The logic operation circuit is connected through a bus 38 to an input port (I/P) 36 for inputting detection signals from the respective sensors and also to an output port (O/P) 37 for outputting control signals to the respective actuators. The ECU 31 inputs the intake air temperature Tam, intake air pressure PM, throttle opening TH, cooling water temperature Thw, number Ne of engine rotations, air-fuel ratio signal, etc. from the respective sensors through the input port 36 and, on the basis of these values, calculates control signals such as a fuel injection time TAU, ignition timing Ig, etc. and outputs these control signals to the fuel injection valve 7, ignition circuit 9, etc. through the output port 37. It is to be noted that in this embodiment form the CPU 32 within the ECU 31 constitutes target air-fuel ratio setting means, operation state determining means, first air-fuel ratio feedback control means, second air-fuel ratio feedback control means and "rich" side target air-fuel ratio setting means (first and second target value setting means).

Next, the operation of the air-fuel control apparatus that is constructed as mentioned above will be explained.

Figure 4:
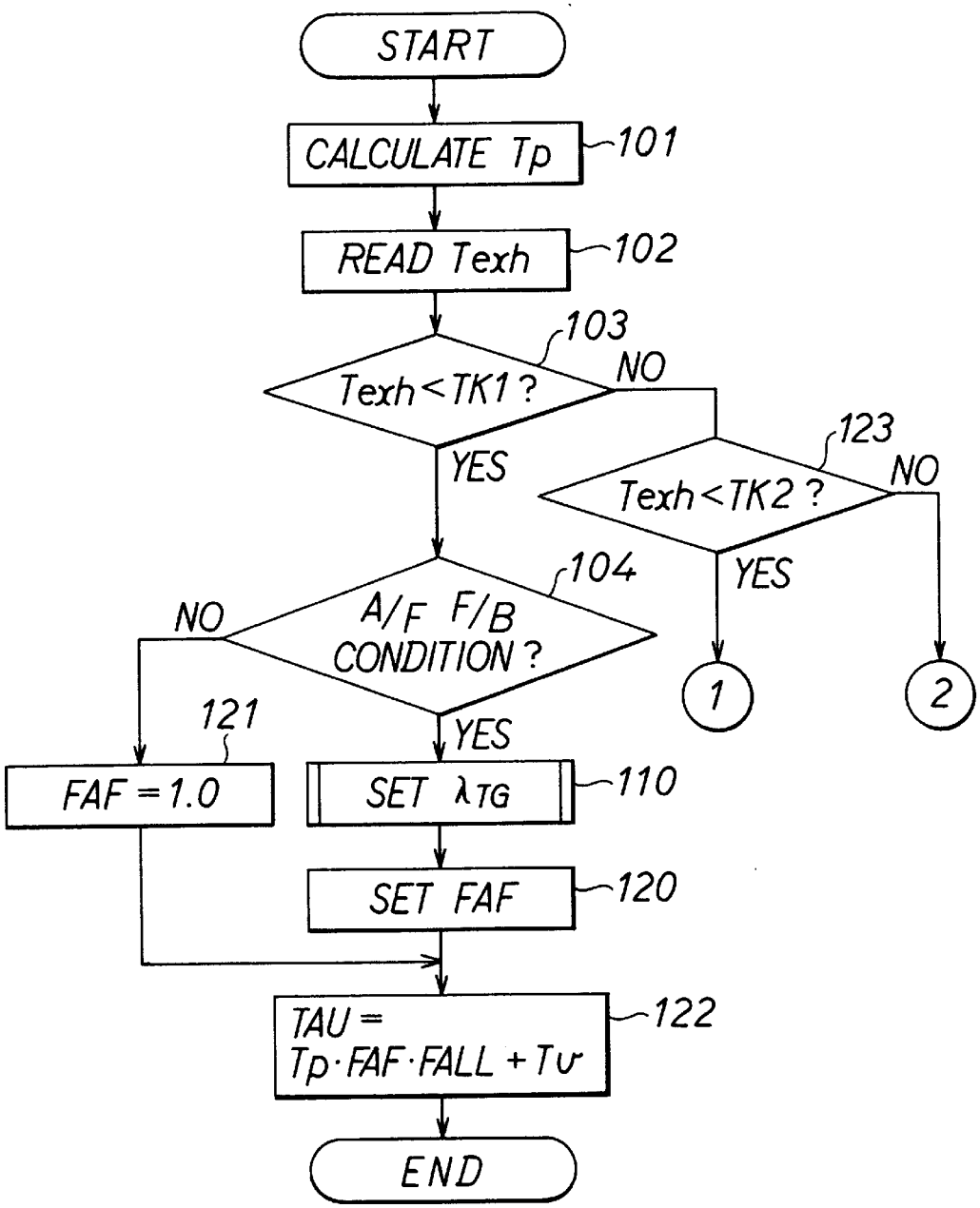
FIG. 4 is a flow chart illustrating a fuel injection control routine.
Figure 5:
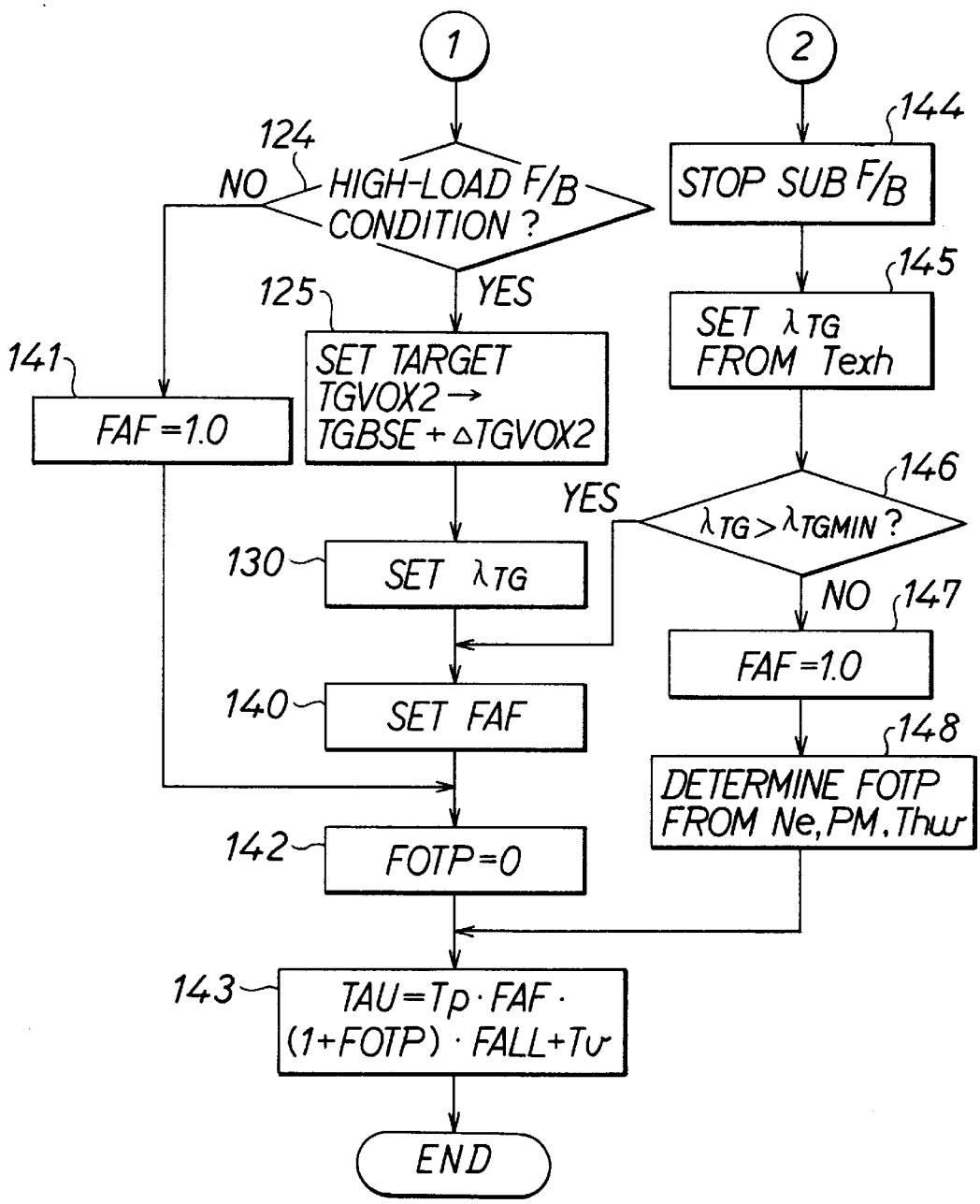
FIG. 5 is a flow chart illustrating the fuel injection control routine which succeeds that illustrated in FIG. 4.

FIGS. 4 and 5 are flow charts illustrating a fuel injection control routine in this embodiment and this routine is executed by the CPU 32 each time fuel injection is performed (in this embodiment in unit of 180° CA).

Figure 8:
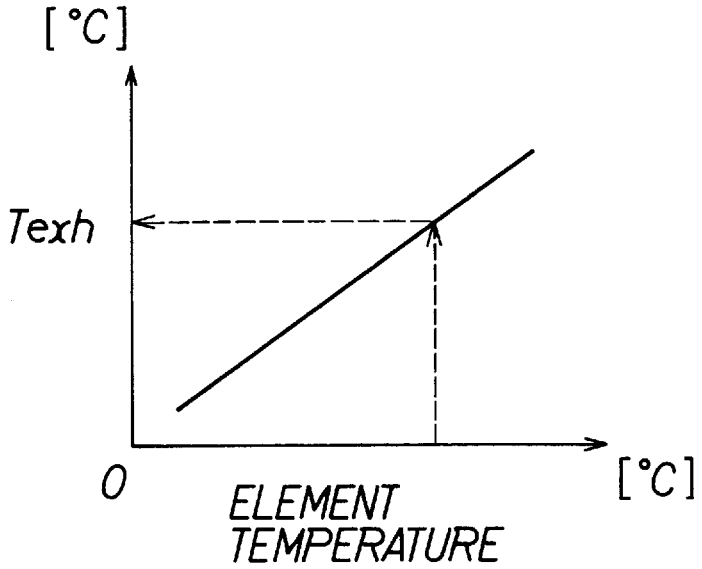
FIG. 8 is a map that is used for estimating an exhaust gas temperature.
Figure 9:
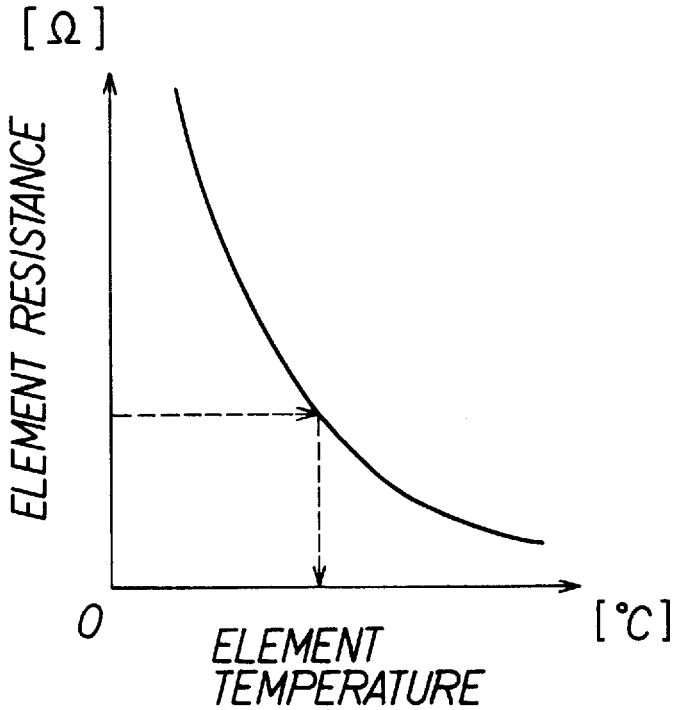
FIG. 9 is a graph illustrating the relationship between the element temperature and the element resistance.

Upon start of the routine, first, in step 101, the CPU 32 calculates, using a basic injection map stored previously in the ROM 33, a basic injection time $T_P$ from the number of engine rotations Ne and intake air pressure PM at this point in time. Also, in step 102, the CPU 32 reads an exhaust gas temperature Texh that is determined through execution of another exhaust gas temperature routine not illustrated. It is to be noted here that the exhaust gas temperature Texh is estimated using the relationship of, for example, FIG. 8. In FIG. 8, as the element temperature of the A/F sensor 26 becomes more increased, the exhaust gas temperature Texh is estimated to be at a value that is correspondingly larger. At this time, the element temperature is determined using the relationship of FIG. 9 and the element resistance in FIG. 9 is calculated from the voltage that is applied to the A/F sensor 26 and the output current thereof that flows at this point in time (the element resistance=applied voltage/sensor output current).

After reading the exhaust gas temperature Texh, in step 103 the CPU 32 determines whether the exhaust gas temperature Texh is lower than that corresponding to a first determining value TK1. This determining value TK1 is a value for determining whether the operational state of the engine has reached a range of high load and, in this embodiment, is set to be TK1=800° C.

When the exhaust gas temperature Texh is lower than the first determining value TK1 (exhaust gas temperature<800° C.), the processing operation of the CPU 32 proceeds to step 104 in which it is determined whether the air-fuel ratio feedback (A/F F/B) conditions are established. It is to be noted here that as well known, the air-fuel ratio feedback conditions are established when the cooling water temperature Thw is not lower than a prescribed value and the operational state of the engine is not in a range of high rotation and high load. When the air-fuel ratio feedback conditions are established, the processing operation of the CPU 32 proceeds to step 110 in which a target air-fuel ratio $\lambda_{TG}$ is set. The setting processing therefor is performed in accordance with a routing that is illustrated in FIG. 6.

Figure 6:
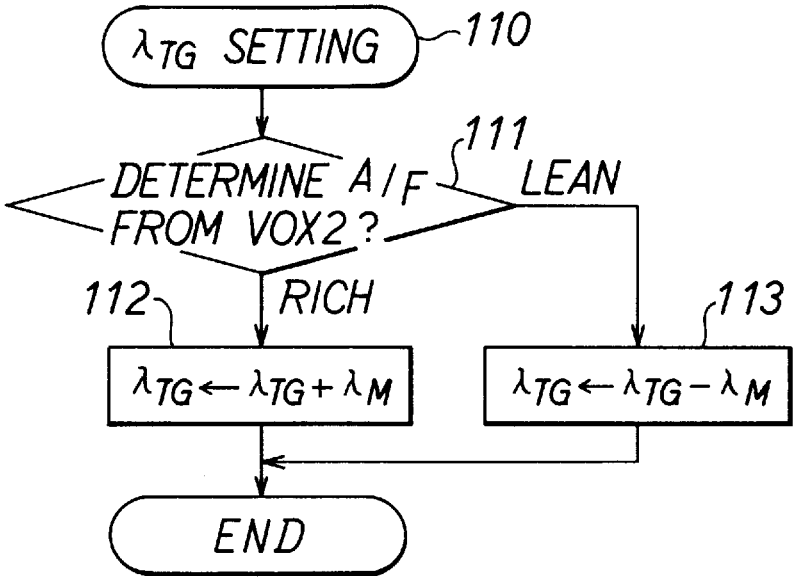
FIG. 6 is a flow chart illustrating a $\lambda_{TG}$ setting routine that corresponds to the processing performed in FIG. 4.

That is, in the $\lambda_{TG}$ setting routine of FIG. 6, in step 111, the CPU 32 determines, according to the output voltage VOX2 of the downstream side $O_2$ sensor 27, to which one of the "rich" side and "lean" side the present air-fuel ratio $\lambda$ is in a state of deviation from the target air-fuel ratio $\lambda_{TG}$ (in this embodiment form, $\lambda_{TG}=1$). In this case, if the present air-fuel ratio A is in a state of deviation to the "rich" side, the CPU 32 proceeds to step 112 in which a prescribed width $\lambda M$ is added to the target air-fuel ratio $\lambda_{TG}$. Namely, the target air-fuel ratio $\lambda_{TG}$ is shifted to the "lean" side. Conversely, if the air-fuel ratio A is in a state of deviation to the "lean" side, the CPU 32 proceeds to step 113 in which a prescribed width $\lambda M$ is subtracted from the target air-fuel ratio $\lambda_{TG}$. Namely, the target air-fuel ratio $\lambda_{TG}$ is shifted to the "rich" side. After setting of the target air-fuel ratio $\lambda_{TG}$, the operation of the CPU 32 returns to the routine of FIG. 4.

In the $\lambda_{TG}$ setting processing in step 110, according to the output voltage VOX2 of the downstream side $O_2$ sensor 27, a deviation between the target air-fuel ratio $\lambda_{TG}$ and the air-fuel ratio A at that point is corrected. This correction processing is referred to as a "sub feedback control".

Thereafter, in step 120, the CPU 32 sets a feedback correction factor FAF for bringing the detected results (air-fuel ratio $\lambda$) of the A/F sensor 26 into coincidence with the target air-fuel ratio $\lambda_{TG}$. Here, the feedback correction factor FAF is calculated using the following equations (1) and (2). It is to be noted that the procedures for setting this feedback correction factor FAF are disclosed in Japanese Patent Application Laid-open Publication No. 1-110853.

$$FAF(i) = K1 \cdot \lambda(i) + K2 \cdot FAF(i-3) + K3 \cdot FAF(i-2) + K4 \cdot FAF(i-1) + ZI(i) \quad (1)$$

$$ZI(i) = ZI(i-1) - Ka \cdot (\lambda_{TG} - \lambda(i)) \quad (2)$$

Provided, however, that in the equations (1) and (2), "i" represents a variable that indicates the frequency of controls as counted from the start of sampling, K1 to K4 represents optimum feedback gains respectively, ZI (i) represents an integral term, and Ka represents an integration constant.

Also, when in step 104 the feedback conditions are not established, the operation of the CPU 32 proceeds to step 121 in which the feedback correction factor FAF is set to be 1.0 which in effect disables the feedback control.

After setting of the feedback correction factor FAF (after the executions of the processing operations in steps 120 and 121), in step 122, using the following equation (3), the CPU 32 sets the fuel injection time TAU from the basic injection time $T_P$, feedback correction factor FAF, other correction factors (various correction factors for water temperature, air-conditioner load, etc.) FALL and invalid injection time Tv, whereupon this routine is ended.

$$TAU=T_P \cdot FAF \cdot FALL+Tv \quad (3)$$

On the other hand, when in step 103 the exhaust gas temperature Texh is not lower than that corresponding to the first determining value TK1 (the exhaust gas temperature≧800° C.), the processing operation of the CPU 32 proceeds to step 123 in which it is determined whether the exhaust gas temperature is lower than that corresponding to a second determining value TK2. This second determining value TK2 is a value for determining a range of load that is higher than the high load which corresponds to the first determining value TK1 (800° C.) and, in this embodiment form, is set to be TK2=850° C. It is to be noted that the first and second determining values TK1 and TK2 are each set based on a heat resisting temperature (900° C.) of the three-way catalyst 13 and is set to be a value that is smaller than that corresponding to this heat resisting temperature.

If the determination on the process in step 123 is YES, the processing operation of the CPU 32 proceeds to step 124 in FIG. 5 whereas if the determination on the process in step 123 is NO, the processing operation of the CPU 32 proceeds to step 144 in FIG. 5. Namely, when TK1≦Texh<TK1 (800° C.≦Texh<850° C.), the CPU 32 determines in step 124 whether high-load feedback conditions are established. The high-load feedback conditions include the conditions wherein excessive fuel increment corrections that are at the starting time, due to air-conditioner load, etc. are not being performed and the conditions wherein the A/F sensor 26 and downstream side $O_2$ sensor are each in an activated state.

Figure 10:
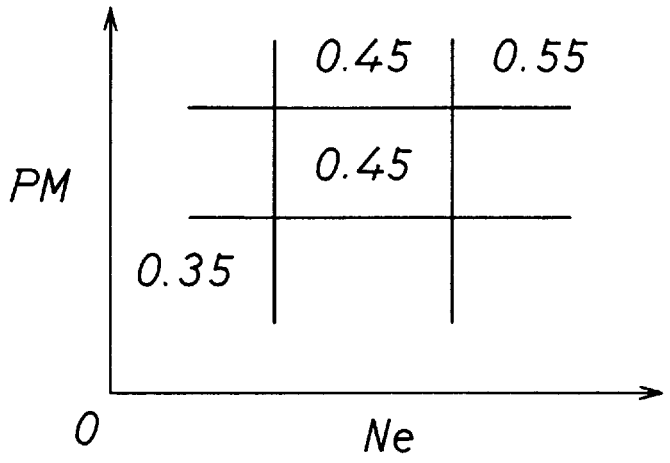
FIG. 10 is a map that is used for calculating a base voltage TGBS.

If the high-load feedback conditions are established, the CPU 32 sets in step 125 the target output voltage TGVOX2 of the downstream side $O_2$ sensor 27 as follows. Namely, in step 125, using a map illustrated in FIG. 10, the CPU 32 determines a basic voltage TGBSE that corresponds to the number Ne of engine rotations and intake air pressure PM at that point in time and also adds a prescribed voltage altering value ΔTGVOX2 to the basic voltage TGBSE, and sets this added value to be the target output voltage TGVOX2 (TGVOX2=TGBSE+ΔTGVOX2). At this time, the basic voltage TGBSE is set to be at around a voltage value (0.45 V) that corresponds to the stoichiometric air-fuel ratio. Also, the voltage altering value ΔTGVOX2 is an altering value for making the air-fuel ratio λ "rich" as a result of the rise in the exhaust gas temperature Texh and, in this embodiment, set to be ΔTGVOX2=0.2 [V].

Thereafter, the CPU 32 sets in step 130 the target air-fuel ratio $\lambda_{TG}$ that corresponds to the target output voltage TGVOX2 of the downstream side $O_2$ sensor 27. The process for setting the target air-fuel ratio $\lambda_{TG}$ is executed in accordance with a routing illustrated in FIG. 7.

Figure 7:
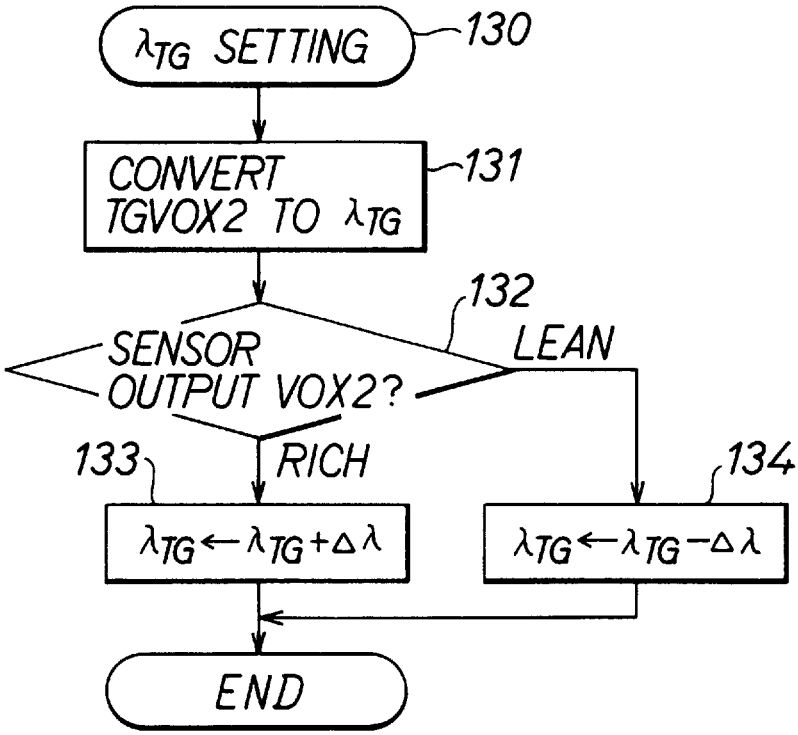
FIG. 7 is a flow chart illustrating a $\lambda_{TG}$ setting routine that corresponds to the processing performed in FIG. 5.

That is, in the $\lambda_{TG}$ setting routine of FIG. 7, in step 131, the CPU 32 converts the above-mentioned target output voltage TGVOX2 to the target air-fuel ratio $\lambda_{TG}$ based on the output characteristic of the downstream side $O_2$ sensor 27. Also, in subsequent steps 132 to 134, the CPU 32 executes the sub feedback control based on the output voltage VOX2 of the downstream side $O_2$ sensor 27. Specifically, in step 132, the CPU 32 determines, according to the output voltage VOX2 of the downstream side $O_2$ sensor 27, to which one of the "rich" side and "lean" side the present air-fuel ratio λ is in a state of deviation from the target air-fuel ratio $\lambda_{TG}$. In this case, if the present air-fuel ratio λ is in a state of deviation to the "rich" side, the CPU 32 proceeds to step 133 in which a prescribed width Δλ is added to the target air-fuel ratio $\lambda_{TG}$. Namely, the target air-fuel ratio $\lambda_{TG}$ is shifted to the "lean" side. It is to be noted here that the prescribed value Δλ is a very small value for changing the output voltage VOX2 in a range of linear changes thereof. Conversely, if the air-fuel ratio λ is in a state of deviation to the "lean" side, the CPU 32 proceeds to step 134 in which a prescribed value Δλ is subtracted from the target air-fuel ratio $\lambda_{TG}$. Namely, the target air-fuel ratio $\lambda_{TG}$ is shifted to the "rich" side. After setting of the target air-fuel ratio $\lambda_{TG}$, the operation of the CPU 32 returns to the routine of FIG. 5.

Figure 11:
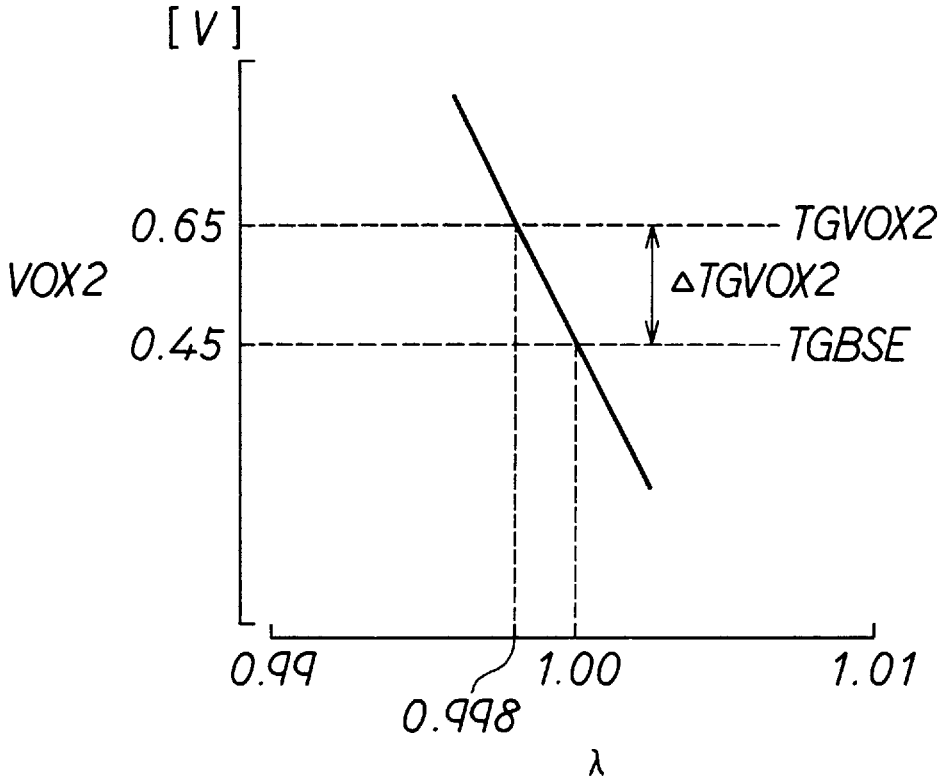
FIG. 11 is a graph illustrating the output characteristic of a downstream side $O_2$ sensor by enlarging it at around the stoichiometric air-fuel ratio.

The content of the sub feedback control that is executed in steps 125 and 130 will now be described in detail with reference to FIG. 11. It is to be noted that FIG. 11 is a graph illustrating the output characteristic of the downstream side $O_2$ sensor 27 only at around the stoichiometric air-fuel ratio (λ=1) for better understanding. Namely, in FIG. 11, the target output voltage TGVOX2 of the downstream side $O_2$ sensor 27 is one wherein the voltage altering value ΔTGVOX2 (0.2 V) is added to the basic voltage TGBSE (in the Figure, 0.45 V). This voltage value is in a range wherein the air-fuel ratio can be linearly detected by the downstream side $O_2$ sensor 27. Therefore, sub feedback control is executed by the output voltage VOX2 by the use of this linear detectable range of FIG. 11. At this time, if the target output voltage TGVOX2 is 0.65 V, the target air-fuel ratio $\lambda_{TG}$ is set to be [$\lambda_{TG}$=0.998] that is in a state of having been slightly shifted to the "rich" side from the stoichiometric air-fuel ratio.

Thereafter, in step 140, using the above-mentioned equations (1) and (2), the CPU 32 sets the feedback correction factor FAF. It is to be noted that if in step 124 the determination on the processing operation therein is NO, the CPU 32 proceeds to step 141 in which the feedback correction factor FAF is set to be [1.0] indicating no feedback.

After setting of the feedback correction factor FAF (after the executions of the processes in steps 140 and 141), in step 142 the CPU 32 sets a high-temperature correction factor FOTP to be [0]. While the "high-temperature correction factor FOTP" is a correction factor that is used for performing increment in fuel when the exhaust gas temperature has increased, this factor is set to be FOTP=0 because here increment in fuel is performed by making the target air-fuel ratio $\lambda_{TG}$ rich.

Thereafter, in step 143, using the following equation (4), the CPU 32 calculates the final fuel injection time TAU.

$$TAU=T_P \cdot FAF \cdot (1+FOTP) \cdot FALL+Tv \quad (4)$$

On the other hand, if the exhaust gas temperature Texh exceeds the second determining value TK2 (850° C.) and the determination on the process in step 123 in FIG. 4 is NO, the operation of the CPU 32 proceeds to step 144 in FIG. 5 in which the sub feedback control is stopped. Namely, while when Texh<TK2 (the exhaust gas temperature<850° C.) sub feedback control has been executed (the $\lambda_{TG}$ setting routines in FIGS. 6 and 7), based on the output voltage VOX2 of the downstream side $O_2$ sensor 27, in such a direction as to reduce to zero a deviation between the air-fuel ratio λ and the target air-fuel ratio $\lambda_{TG}$ at that point in time, this sub feedback control is stopped when the relationship of Texh≧TK2 holds. Accordingly, in the succeeding processings, air-fuel ratio control is executed without using the output voltage VOX2 of the downstream $O_2$ sensor 27.

Figure 12:
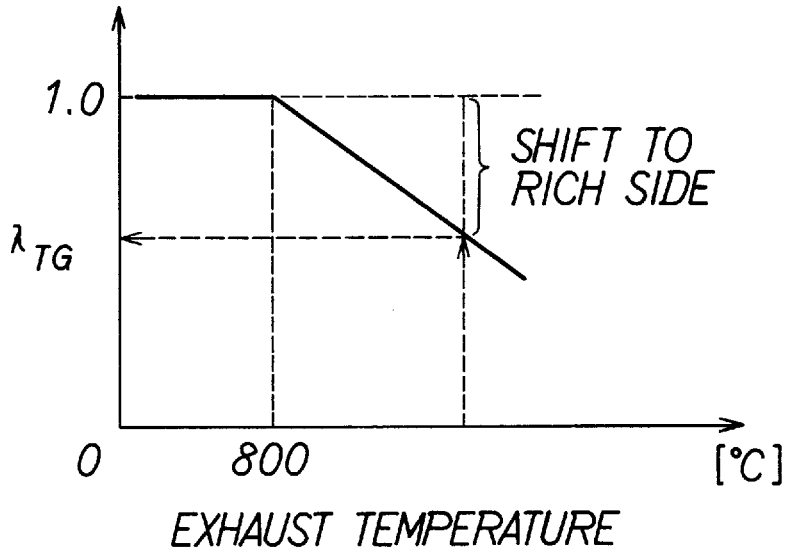
FIG. 12 is a map that is used for setting a target air-fuel ratio $\lambda_{TG}$ that corresponds to the temperature of the exhaust gas.

Thereafter, in step 145, using a characteristic diagram of FIG. 12, the CPU 32 sets the target air-fuel ratio $\lambda_{TG}$ in correspondence with the exhaust gas temperature Texh at that point in time. In the characteristic diagram of FIG. 12, it is arranged to permit the target air-fuel ratio $\lambda_{TG}$ to be set at which the width of shift thereof from the stoichiometric air-fuel ratio to the "rich" side becomes minimum while suppressing the rise in the exhaust gas temperature.

Figure 13:
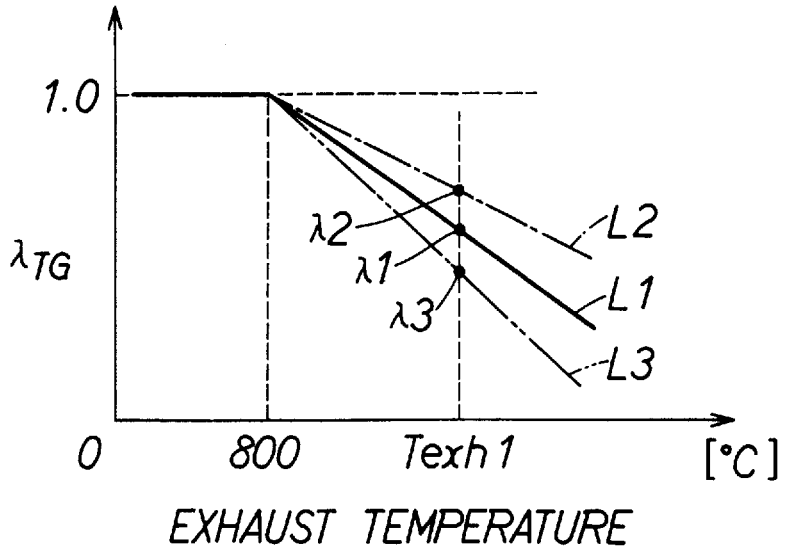
FIG. 13 is a map that is used for illustrating the characterizing part of FIG. 12.

Here, the characterizing features of the target air-fuel ratio $\lambda_{TG}$ that has been set using the characteristic diagram of FIG. 12 will be explained. In FIG. 13, a line [L1] represents a characteristic that has been set in this embodiment and lines [L2 (one-dot chain line)] and [L3 (two-dot chain line)] represent characteristics for comparison.

In short, when the target air-fuel ratios $\lambda_{TG}$ that are set in correspondence with a prescribed exhaust gas temperature Texh 1 are compared with each other in regard to the respective characteristics L1 to L3, the [λ2] that is set by the characteristic L2 excessively decreases in width of shift to the "rich" side, which results in that the rise in the exhaust gas temperature cannot be suppressed (or the decrease in the exhaust gas temperature is delayed). Also, the [λ3] that is set by the characteristic L3 excessively increases in width of shift to the "rich" side, which results in that although the rise in the exhaust gas temperature can be suppressed, the emission deterioration becomes prominent. In contrast, the [λ1] that is set by the characteristic L1 enables suppression of the emission deterioration to a minimum level while suppressing the rise in the exhaust gas temperature. That is, the characteristic L1 is set so that the width of shift to the "rich" side may become minimum in a prescribed region (a region lower than L2) in which the rise in the exhaust gas temperature is possible to suppress.

After setting of the target air-fuel ratio $\lambda_{TG}$, in step 146, the CPU 32 determines whether the target air-fuel ratio $\lambda_{TG}$ at that point in time is higher than a minimum air-fuel ratio $\lambda_{TGMIN}$ (=0.8) that is defined by the range of detection (see FIG. 2) made by the A/F sensor 26. If the determination on the process in step 146 is YES, the processing operation of the CPU 32 proceeds to step 140 in which the feedback correction FAF is set using the equations (1) and (2). Thereafter, as stated previously, the processes in step 142 and 143 are executed, wherein the fuel injection time TAU is calculated using the equation (4).

Figure 14:
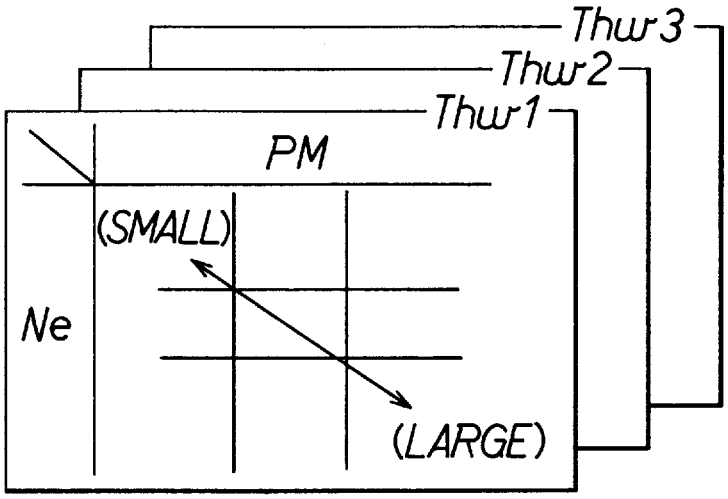
FIG. 14 is a map that is used for setting the at-high-temperature correction factor FOTP.

Also, if the determination on the process in step 146 is NO, the processing operation of the CPU 32 proceeds to step 147 in which the feedback correction factor FAF is set to be [1.0]. Namely, air-fuel ratio control is changed to the open-loop control. Also, in subsequent step 148, using a map of FIG. 14, the CPU 32 determines the high-temperature correction factor FOTP that corresponds to the operational state of engine (the number Ne of engine rotations, intake air pressure PM and cooling water temperature Thw) at a point in time that corresponds thereto. It is to be noted here that according to the map of FIG. 14, as the engine rotation and engine load increase, at a larger value is set the high-temperature correction factor FOTP.

Figure 15:
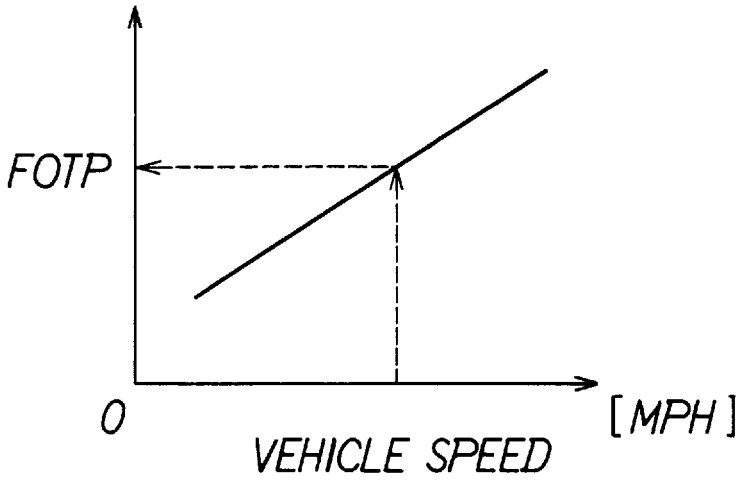
FIG. 15 is a map that is used for setting the at-high-temperature correction factor FOTP.

As another method for calculating the high-temperature correction factor FOTP, it is also possible to calculate a value that corresponds to the vehicle speed, by using the relationship illustrated in FIG. 15.

Thereafter, the processing operation of the CPU 32 proceeds to step 143 in which it calculates the fuel injection time TAU by the use of the above-mentioned equation (4). At this time, although the feedback correction factor FAF is set to be [1.0], the fuel injection time TAU is corrected by the high-temperature correction factor FOTP, whereby the quantity of fuel injected is increased.

Next, the fuel injection control routine that is illustrated in FIGS. 4 and 5 will be explained using time charts of FIGS. 16A–16F. In these figures, a time t1 and a time t2 represent the timings, respectively, with which the exhaust gas temperature Texh has risen and become higher than that corresponding to the first TK1 and the second determining value TK2. A time t4 and a time t5 represent the timings, respectively, with which the exhaust gas temperature Texh has been lowered and become lower than that corresponding to the second TK2 and the first determining value TK1.

Figures 16A, 16B, 16C, 16D, 16E, 16F:
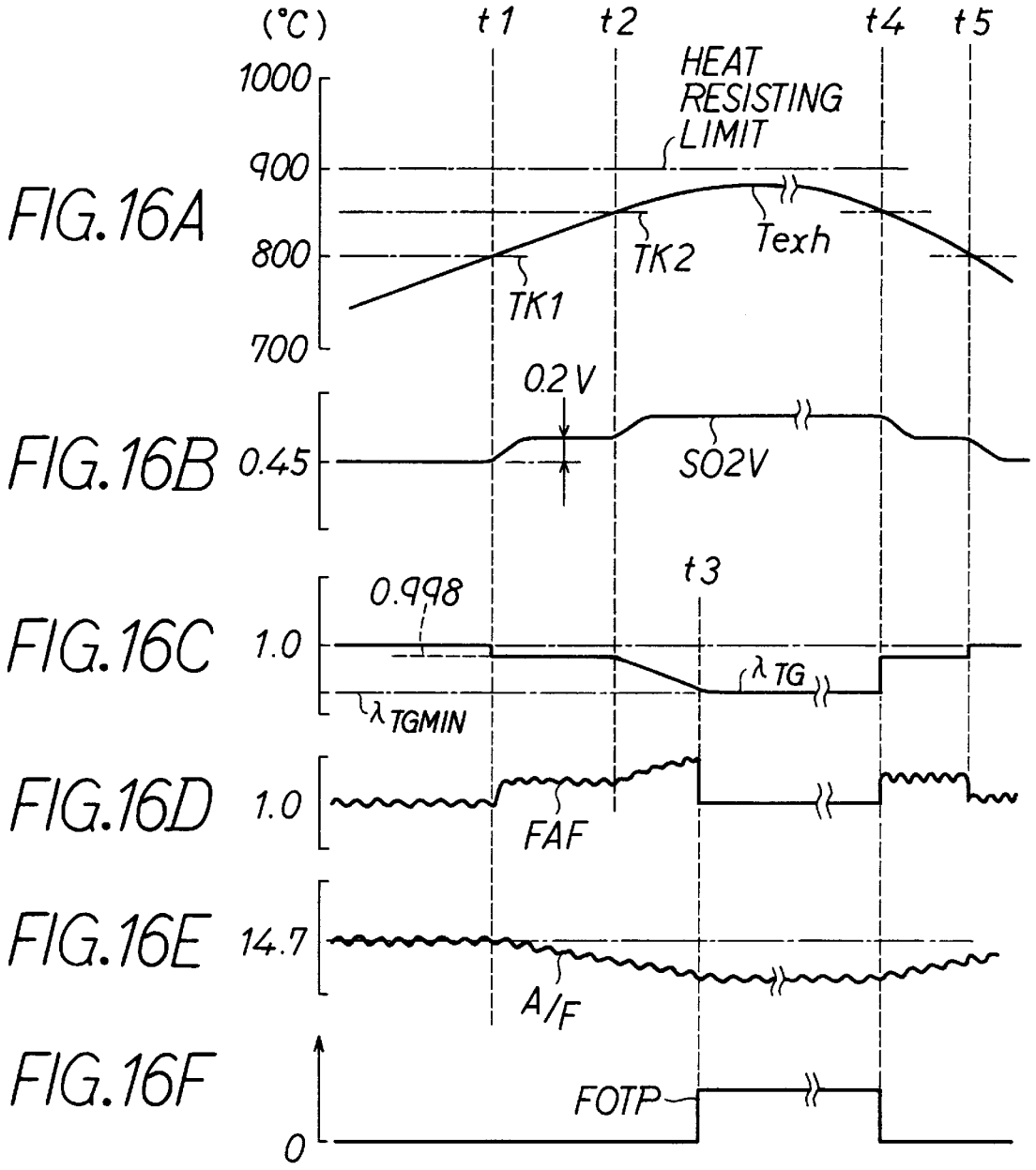
FIGS. 16A–16F are time charts illustrating the operation in this embodiment.

In FIG. 16A, prior to the time t1, the process in step 103 in FIG. 4 is determined to be YES (Texh<TK1), whereupon the CPU 32 proceeds from step 103 to steps 104→110→120→122 in this order (provided, however, that this step-to-step transfer is made when the air-fuel ratio feedback conditions have been established). At this time, air-fuel ratio feedback control is executed so as to bring the air-fuel ratio A to the target air-fuel ratio $\lambda_{TG}$ (in FIG. 16C, $\lambda_{TG}$=1.0).

During a time period of from t1 to t2, the process in step 103 in FIG. 4 is determined to be NO and then the process in step 123 is determined to be YES (TK1≦Texh<TK2), whereupon the CPU 32 proceeds from step 123 to steps 124→125→130→140→142→143 in this order (provided, however, that this step-to-step transfer is made when the during-high-load feedback conditions have been established). At this time, air-fuel feedback control is executed so as to bring the air-fuel ratio λ to the target air-fuel ratio $\lambda_{TG}$ set in such a manner as to be shifted slightly to the "rich" side (in FIG. 16C, $\lambda_{TG}$=0.998).

During a time period of from t2 to t3, the determination on the process in step 123 in FIG. 4 is NO (Texh≧TK2) and the determination on the process in step 146 in FIG. 5 is YES (λ>λ TGMIN). For this reason, the processing operation of the CPU 32 proceeds from step 123 to steps 144→145→146→140→142→143 in this order. At this time, air-fuel feedback control is executed so as to bring the air-fuel ratio λ to the target air-fuel ratio $\lambda_{TG}$ that has been set in correspondence with the exhaust gas temperature Texh by retrieval of the map.

During a time period from t3 to t4, the determination of the process in step 146 in FIG. 5 is made to be NO (λ≦λTGMIN). For this reason, the processing operation of the CPU 32 proceeds from step 146 to steps 147→148→143 in this order. At this time, air-fuel control is executed in the form of open-loop control (FAF=1.0 in FIG. 16D), whereby the quantity of fuel to be injected is increased by the extent that corresponds to the high-temperature correction factor.

Thereafter, during a time period of from t4 to t5, by the processes in steps 125 and 130 in FIG. 5 being again executed, the target air-fuel ratio $\lambda_{TG}$ is set in such a manner as to have been shifted to the "rich" side in a very small amount, whereby air-fuel ratio feedback control that is to be executed during high load is re-started. Also, at the time t5 and thereafter, the air-fuel ratio control operation returns to the ordinary air-fuel ratio feedback control. It is to be noted that the sub feedback control is executed both prior to the time t2 and after the time t4.

Subsequently, the effect that is obtained from the use of the above-mentioned air-fuel ratio control apparatus will be explained. That is, in this embodiment, that the operational state of the engine is in a range of high load is determined from the exhaust gas temperature Texh. As a result, when the exhaust gas temperature Texh exceeds the first determining value TK1 (800° C.), the target air-fuel ratio $\lambda_{TG}$ is set in such a manner as to have been shifted to the "rich" side within a range of air-fuel ratios that are linearly detectable by the downstream side $O_2$ sensor 27 and that are at around the stoichiometric air-fuel ratio (step 125 in FIG. 5). Also, the target air-fuel ratio $\lambda_{TG}$ is corrected in correspondence with a deviation between the detected air-fuel results of the downstream side $O_2$ sensor 27 and the target air-fuel ratio $\lambda_{TG}$ at that point in time (step 130 in FIG. 5). According to this construction, at an initial stage of the engine operation in a high load range, precise air-fuel sensor feedback control can be realized, with the result that the emission deterioration can be suppressed.

Also, when the exhaust gas temperature Texh exceeds the second determining value TK2 (850° C.), since the width of the target air-fuel ratio $\lambda_{TG}$ being shifted to the "rich" side becomes wider, the process of setting the target air-fuel ratio $\lambda_{TG}$ within the range of linear detection of the downstream side $O_2$ sensor 27 is stopped and the "rich" side target air-fuel ratio $\lambda_{TG}$ is instead set in correspondence with the exhaust gas temperature Texh at that point in time (step 145 in FIG. 5). At this time, by using the map illustrated in FIG. 12 for setting the target air-fuel ratio $\lambda_{TG}$, this target air-fuel ratio $\lambda_{TG}$ is set so that while suppressing the rise in the exhaust gas temperature Texh to a prescribed permissible range, the width of increment in fuel at that point in time may become minimum. According to this construction, when the level of the load increases, it is possible to set an appropriate target air-fuel ratio $\lambda_{TG}$ at which the decrease in the exhaust gas temperature and the decrease in the exhaust emission are compatible with each other and thereby realize an optimum air-fuel ratio control.

Further, in cases where the target air-fuel ratio $\lambda_{TG}$ is set to a value that has been shifted from the range of air-fuel ratios detectable by the A/F sensor 26 toward the more "rich" side (in cases where the target air-fuel ratio $\lambda_{TG} \leqq 0.8$), air-fuel feedback control is stopped and estimated increment is performed of the fuel injection quantity (step 148 in FIG. 5). In this case, by performing transfer from the feedback control to the open-loop control, the decrease in the exhaust gas temperature can be performed continuously.

As stated above, in this embodiment, when the operational state of the engine has entered a range of high load, the target air-fuel ratio $\lambda_{TG}$ is not only set to the "rich" side in correspondence with the level of the load but is relevant air-fuel ratio control (fuel injection control) also changed over in three stages in correspondence with the amount of fluctuations of this target air-fuel ratio set on the "rich" side. For this reason, however high the level of the load may be, it is possible to decrease the exhaust gas temperature Texh reliably and also prevent the impairments and performance deterioration of the three-way catalyst 13 reliably. Further, it is also possible to realize protection of the A/F sensor 26 and downstream side $O_2$ sensor 27 simultaneously.

Also, by executing feedback control with respect to the "rich" side target air-fuel ratio $\lambda_{TG}$, the emission suppression effect can be obtained. Particularly, by executing precise feedback control by using the range of linear detection of the downstream side $O_2$, it is possible to manage the quantity of emission exhausted reliably.

On the other hand, in this embodiment, the determining values TK1 and TK2 for determining the exhaust gas temperature Texh are set based on the heat resisting temperature (900° C.) of the three-way catalyst 13, whereby the level of the load in the operational state of engine in a range of high load is determined using these determining values TK1 and TK2. As a result of this, the increase or decrease in the exhaust gas temperature can be grasped reliably to thereby enable precise control of the exhaust gas temperature.

Also, in this embodiment, since the exhaust gas temperature Texh is estimated from the element temperature of the A/F sensor 26, it is unnecessary to provide an additional construction such as an exhaust gas temperature sensor and therefore it is possible to detect the exhaust gas temperature Texh easily and reliably.

(Second Embodiment)

Next, a second embodiment will be explained with respect to a difference from the first embodiment. While in the first embodiment, as illustrated in FIG. 1, the linear air-fuel ratio sensor (A/F sensor 26) is disposed on the upstream side of the three-way catalyst 13 and the $O_2$ sensor (the downstream side $O_2$ sensor 27) is disposed on the downstream side thereof, in this second embodiment another linear air-fuel ratio sensor is disposed in place of the downstream side $O_2$ sensor 27. Namely, the linear air-fuel ratio sensors are disposed both on the upstream side and on the downstream side of the three-way catalyst 13, respectively. Sub feedback control is executed using the detected results of these linear air-fuel ratio sensors.

Figure 17:
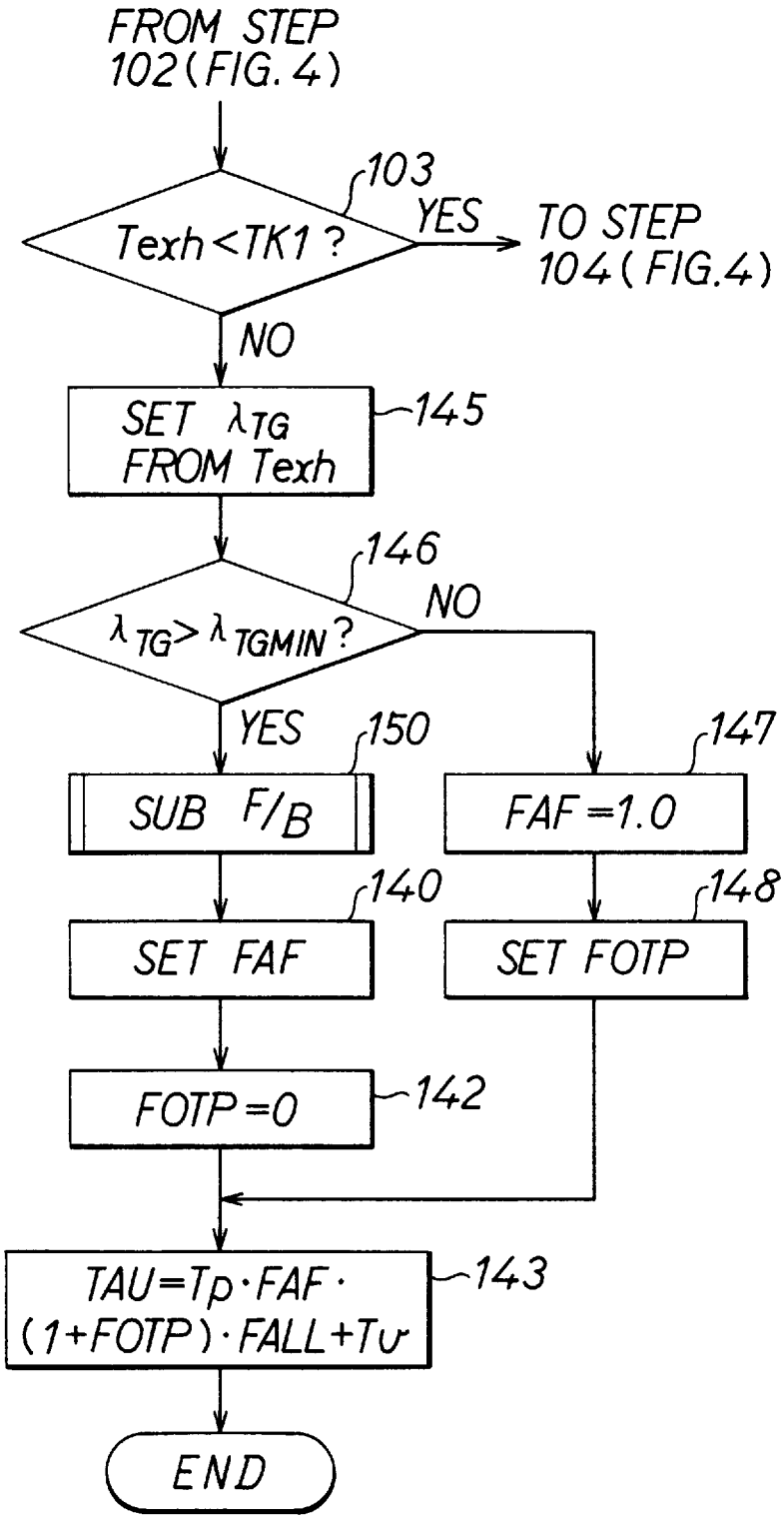
FIG. 17 is a flow chart illustrating part of a fuel injection control routine in a second embodiment of the present invention.

FIG. 17 is a flow chart illustrating a fuel injection control routine in this embodiment. This routine is one which is partially modified from the routine of FIGS. 4 and 5 in the first embodiment, and in which the same step numbers are used with respect to the same step processings, respectively.

In the routine of FIG. 17, determination on the exhaust gas temperature Texh is performed with respect to only the first determining value TK1 (800° C.) alone. If Texh≧TK1, i.e., if it is determined that the operational state of engine is in a range of high load, the CPU 32 executes the process in step 145. Namely, using the map of FIG. 12, setting is performed of the target air-fuel ratio $\lambda_{TG}$ that corresponds to the exhaust gas temperature Texh. Then, if $\lambda_{TG} > \lambda_{TGMIN}$ in the succeeding step 146, the CPU 32 executes in step 150 the sub feedback control by using the detected results of the downstream side linear air-fuel ratio sensor (if $\lambda_{TG} \leqq \lambda_{TGMIN}$, the same processing as that stated previously is executed). Specifically, the target air-fuel ratio $\lambda_{TG}$ is corrected in correspondence with a deviation between this set target air-fuel ratio $\lambda_{TG}$ and the detected results of the linear air-fuel ratio sensor. After execution of step 150, the CPU 32 executes setting of the feedback correction factor FAF and calculation of the final fuel injection time TAU in the same manner as stated previously.

As mentioned above, in this second embodiment, the sub feedback control that is based on the detected results of the linear air-fuel ratio sensor is executed instead of the sub feedback control that is based on the output voltage VOX2 of the downstream side $O_2$ sensor 27. In this case, in a range of air-fuel ratios that are at around the stoichiometric air-fuel ratio, detection precision is higher in the $O_2$ sensor. Therefore, in this range, detection precision becomes somewhat rough compared with that which is obtained when using the range of linear detection of the downstream side $O_2$ sensor. However, since the difference in detection precision between the both sensors is very small, this second embodiment can achieve the object of the present invention to the same extent as in the first embodiment.

It is to be noted that the present invention may be embodied in addition to the above-mentioned embodiments also as follows.

(1) By omitting the provision of the air-fuel ratio sensor on the downstream side of the three-way catalyst 13, the present invention may be embodied with the use of only the upstream side air-fuel sensor alone (any one of the linear air-fuel ratio sensor and $O_2$ sensor may be used). In this case, although control precision becomes somewhat deteriorated because of a failure to execute the sub feedback control, the present invention can be readily embodied.

(2) Although in each of the above-mentioned embodiments the exhaust gas temperature Texh for determining whether the operational state of engine is in a range of high load is estimated based on the element temperature of the A/F sensor 26 (FIG. 8), this method of estimating the exhaust gas temperature may be altered as follows.

Figure 18:
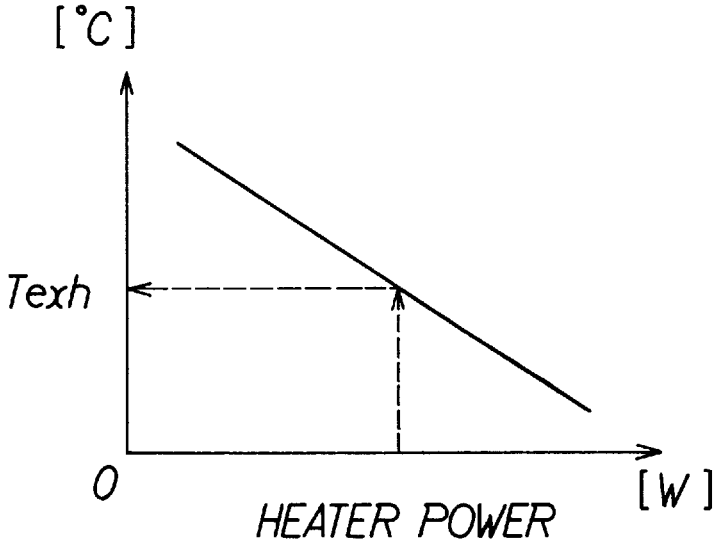
FIG. 18 is a map that is used for estimating the exhaust gas temperature from a heater power in another embodiment.

For example, in cases where the element temperature of the A/F sensor 26 is feedback controlled, the electric power (heater power) that is supplied to the heater 26*a* equipped to this sensor 26 varies in correspondence with the exhaust gas temperature Texh. Therefore, using a map illustrated in FIG. 18, the exhaust gas temperature Texh is estimated in correspondence with the heater power. In this case, the larger the heater power is, the lower estimated to be the exhaust gas temperature Texh is.

Figure 19:
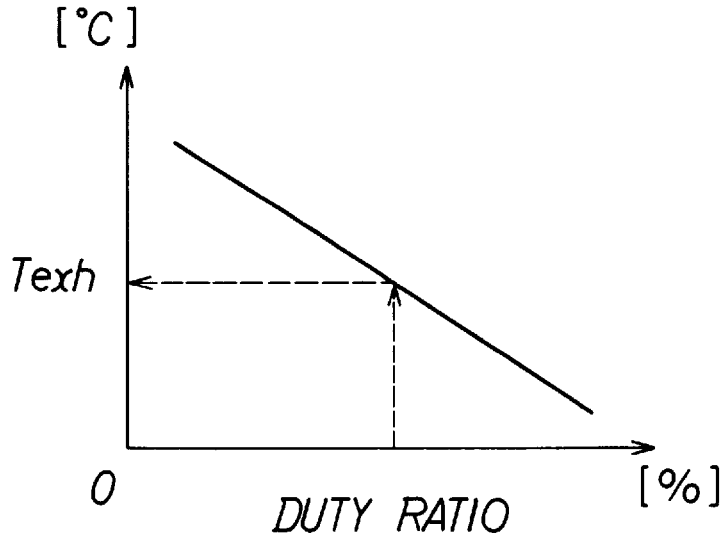
FIG. 19 is a map that is used for estimating the exhaust gas temperature from a heater conduction duty ratio in another embodiment.

Also, similarly, if in cases where the element temperature of the A/F sensor 26 is feedback controlled in order to maintain this sensor 26 in an activated state the conduction of the heater 26*a* is duty controlled, the exhaust gas temperature Texh can be estimated also based on the duty ratio (%) that corresponds to the conduction time duration of the heater 26*a*. Namely, using a map illustrated in FIG. 19, the exhaust gas temperature Texh can be estimated. In this case, the higher the duty ratio (%) is, the lower estimated to be the exhaust gas temperature Texh is. It is to be noted here that in this map the conduction time duration may instead be plotted on the abscissa.

Figure 20:
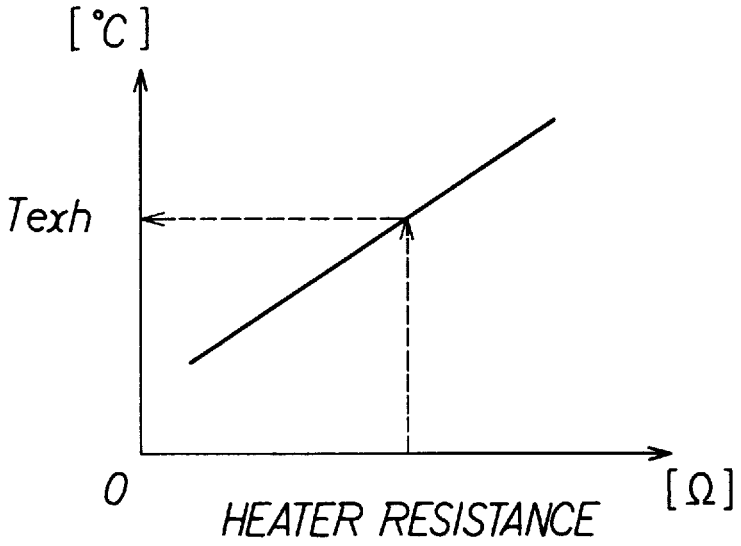
FIG. 20 is a map that is used for estimating the exhaust gas temperature from a heater resistance in another embodiment.

Also, the exhaust gas temperature Texh fluctuates in correspondence with the resistance value of the heater 26*a*. Therefore, by determining the heater resistance from the heater current and the heater voltage (the heater resistance= heater voltage/heater current), the exhaust gas temperature Texh is estimated using a map illustrated in FIG. 20. In this case, the higher the heater resistance is, at the larger value estimated to be the exhaust gas temperature Texh is.

Figure 21:
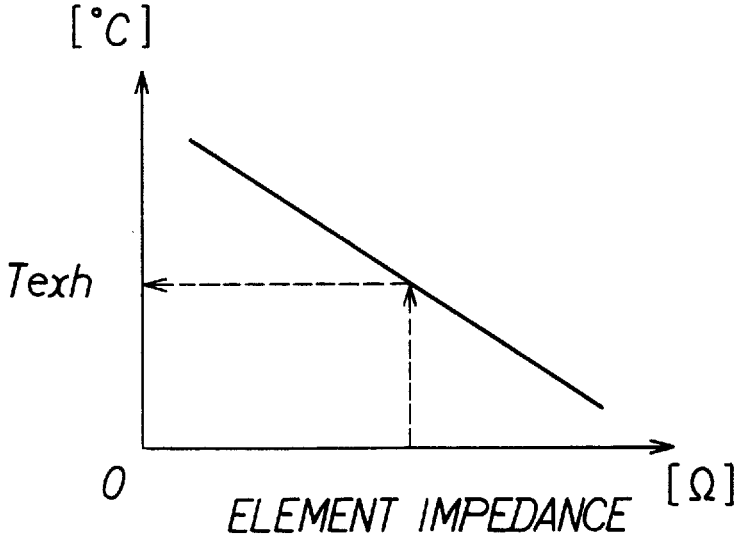
FIG. 21 is a map that is used for estimating the exhaust gas temperature from an impedance of the element interior in another embodiment.

Further, as illustrated in FIG. 21, the exhaust gas temperature Texh may be estimated in correspondence with the impedance of the element interior (Ω) of the A/F sensor 26. This impedance of the element interior is calculated from the applied voltage with respect to the A/F sensor 26 and the output current thereof at that point in time (the internal impedance of the element=applied voltage/sensor output voltage). In this case, the higher the impedance of the element is, at the larger value estimated to be the exhaust gas temperature Texh is.

It is to be noted that although the estimation processings of the exhaust gas temperature Texh that use the maps of FIGS. 18 to 21 have been executed based on the activated state of the A/F sensor 26 as the upstream side air-fuel ratio sensor or based on the state of the heater, such estimation processings may also be executed based on the activated state of the downstream side $O_2$ sensor 27 as the downstream side air-fuel ratio sensor or based on the state of a heater not illustrated of that sensor 27.

Figure 22A:
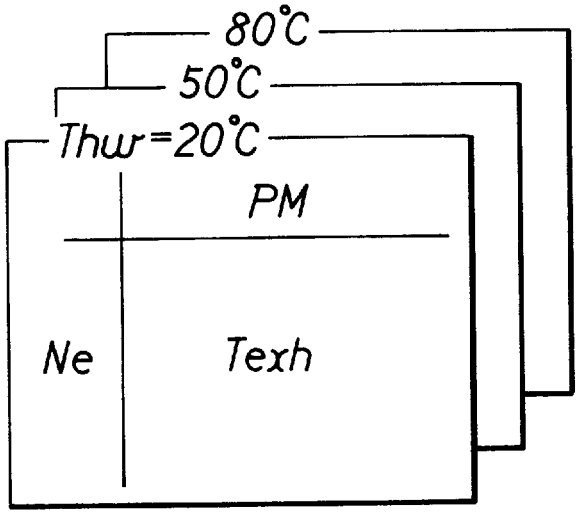
FIGS. 22A and 22B are maps used for estimating the exhaust gas temperature from a vehicle speed or operational state of the internal combustion engine in another embodiment.
Figure 22B:
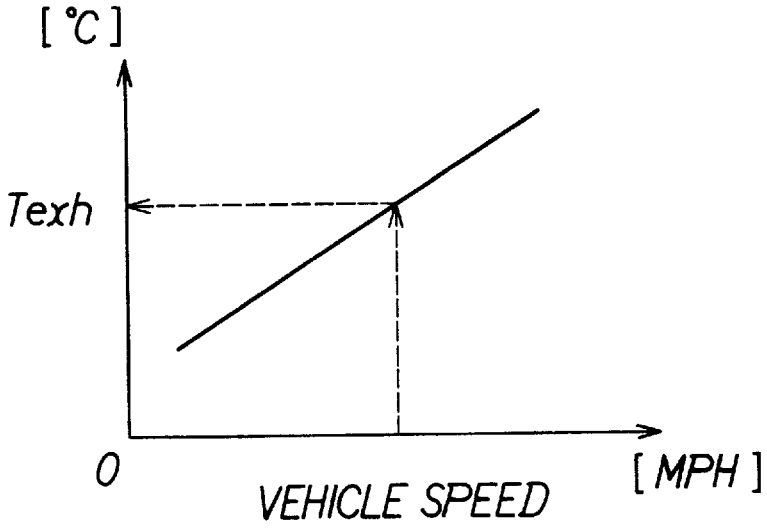

Further, as another method of estimation, as illustrated in FIGS. 22A and 22B, the exhaust gas temperature Texh may be estimated in correspondence with the operational state of the vehicle or internal combustion engine. Namely, in FIG. 22A, an exhaust gas temperature map that has been made to correspond to the operational states of the engine (the number of engine rotations Ne, intake air pressure PM and cooling water temperature Thw) is prepared beforehand in the ROM 33 to thereby estimate the exhaust gas temperature Texh in correspondence with the operational state of the engine at a necessary point in time. At this time, the higher the level of the load in the operational state of the engine is, at the larger value estimated to be the exhaust gas temperature Texh is. It is to be noted that in order to estimate the exhaust gas temperatures Texh from the operational states of the engine as mentioned above, the number of the engine rotations Ne, intake air pressure PM and cooling water temperature Thw may be used as a parameter or parameters singly or in a form wherein any two of them are combined. Also, other parameters such as a throttle opening TH, accelerator depression, etc. may be also combined.

In FIG. 22B, the exhaust gas temperature Texh is estimated in correspondence with the vehicle speed. In this case, the vehicle speed is calculated from, for example, the number of rotations of a drive shaft of the vehicle and, as the vehicle speed increases, the exhaust gas temperature Texh is estimated to be at a larger value. It is to be noted here that the vehicle speed reflects a state of load of the internal combustion engine and therefore it is defined that as the level of the load increases, the speed of the vehicle increases.

In addition, an exhaust gas temperature sensor for directly metering the exhaust gas temperature Texh may be disposed on the exhaust pipe 12, whereby an exhaust gas temperature signal that has been obtained by metering performed by this sensor may be input to the ECU 31.

(3) As a method for determining whether the operational state of engine is in a range of high load, there may be adopted a method wherein the determination thereon is performed from the parameters such as the number of engine rotations Ne, intake air pressure PM, vehicle speed, etc. without performing estimation (or detection) of the exhaust gas temperature Texh.

The technical ideas that can be grasped from the above-mentioned embodiment forms will hereunder be described along with the effects that are attainable therefrom.

(a) A control apparatus for internal combustion engines wherein the temperature of the exhaust gas that is discharged from the internal combustion engine is estimated based on any one or two or more combined ones of parameters representing operational states of the engine, such as a number of engine rotations, intake pipe pressure, cooling water temperature, throttle opening and the like.

(b) A control apparatus for internal combustion engines which comprises state-of-activation estimating means for estimating a state of activation of the upstream side or downstream side air-fuel sensor and in which the temperature of the exhaust gas that is discharged from the internal combustion engine is estimated based on the estimated state of activation of the sensor. It is to be noted here that the state-of-activation estimating means is constituted by the CPU 32 within the ECU 31.

(c) A control apparatus for internal combustion engines, wherein the state-of-activation estimating means estimates the state of activation of the sensor from the element temperature or element resistance (the impedance of the element interior) of the upstream or downstream side air-fuel ratio sensor.

(d) A control apparatus for internal combustion engines wherein a heater for activating the upstream or downstream side air-fuel ratio sensor is equipped to this sensor, whereby the temperature of the exhaust gas that is discharged from the internal combustion engine is estimated based on the power of the heater needed for activating the sensor or based on the conduction time duration of the heater.

(e) A control apparatus for internal combustion engines which comprises control means for performing duty control with respect to the conduction of the heater so as to activate the upstream side or downstream side air-fuel sensor and in which the temperature of the exhaust gas that is discharged from the internal combustion engine is estimated based on the duty ratio that has been obtained from the control means. It is to be noted here that the control means is constituted by the CPU 32 within the ECU 31.

In any one of the inventions set forth under the above items (a) to (e), by embodying the construction thereof, it is possible to estimate the exhaust gas temperature of the internal combustion engine with a high accuracy and also to cause the estimated results to be reflected excellently in the air-fuel ratio control.

What is claimed is:

1. An air-fuel ratio control apparatus for internal combustion engines, comprising:

state-of-load determining means for detecting a state of load of an internal combustion engine equipped with a catalyst on its exhaust gas passageway; and air-fuel ratio control means for controlling an air-fuel ratio of an air-fuel mixture to be supplied to the internal combustion engine; wherein the air-fuel ratio control means includes "rich" side target air-fuel ratio setting means for, when the state of load of the internal combustion engine is in a state of high load, setting a target air-fuel ratio to a "rich" side in correspondence with a level of load of the internal combustion engine and air-fuel ratio feedback means for performing feedback control so that an air-fuel ratio at an upstream side of the catalyst may become the target air-fuel ratio.

2. An air-fuel ratio control apparatus for internal combustion engines as set forth in claim 1, wherein:

the "rich" side target air-fuel ratio setting means sets the target air-fuel ratio so that a rise in the temperature of an exhaust gas from the internal combustion engine may be suppressed to a permissible range of temperature and so that increment in fuel may become minimum.

3. An air-fuel ratio control apparatus for internal combustion engines as set forth in claim 1, wherein:

the "rich" side air-fuel ratio setting means includes means for correcting the target air-fuel ratio in correspondence with a deviation between an air-fuel ratio at a downstream side of the catalyst and the target air-fuel ratio at that point in time.

4. An air-fuel ratio control apparatus for internal combustion engines as set forth in claim 1, wherein:

the air-fuel ratio control means includes means for, when the target air-fuel ratio which has been set by the "rich" side target air-fuel ratio setting means exceeds a range of detectable air-fuel ratios of a linear air-fuel ratio sensor for detecting the air-fuel ratio at the upstream side of the catalyst, stopping the feedback control performed by the feedback means and increasing the fuel injection quantity in an estimated quantity.

5. An air-fuel ratio control apparatus for internal combustion engines as set forth in claim 1, wherein:

the state-of-load determining means is means for determining the state of load in correspondence with a temperature of an exhaust gas which is exhausted from the internal combustion engine.

6. An air-fuel ratio control apparatus for internal combustion engines, comprising:

state-of-load-operation determining means for detecting a state of load of an internal combustion engine equipped with a catalyst on its exhaust gas passageway; and air-fuel ratio control means for controlling an air-fuel ratio of an air-fuel mixture to be supplied to the internal combustion engine; wherein the air-fuel ratio control means includes "rich" side target air-fuel ratio setting means for, when it is determined that the state of load of the internal combustion engine is in a range of high load and when the level of the load is lower than a prescribed value, setting a target air-fuel ratio to a "rich" side by a prescribed width and, when the level of the load is above a prescribed value, setting the target air-fuel ratio to the "rich" side in correspondence with the level of the load, and air-fuel ratio feedback means for performing feedback control so that an air-fuel ratio at an upstream side of the catalyst may become the target air-fuel ratio.

7. An air-fuel ratio control apparatus for internal combustion engines as set forth in claim 6, wherein:

the "rich" side target air-fuel ratio setting means sets the target air-fuel ratio so that a rise in the temperature of an exhaust gas exhausted from the internal combustion engine may be suppressed to a permissible range of temperature and so that increment in fuel may become minimum.

8. An air-fuel ratio control apparatus for internal combustion engines as set forth in claim 6, wherein:

the "rich" side air-fuel ratio setting means includes means for correcting the target air-fuel ratio in correspondence with a deviation between an air-fuel ratio on a downstream side of the catalyst and the target air-fuel ratio at that point in time.

9. An air-fuel ratio control apparatus for internal combustion engines as set forth in claim 6, wherein:

the air-fuel ratio control means includes means for, when the target air-fuel ratio which is set by the "rich" side target air-fuel ratio setting means exceeds a range of detectable air-fuel ratios of a linear air-fuel ratio sensor for detecting the air-fuel ratio at the upstream side of the catalyst, stopping the feedback control performed by the feedback means and increasing the fuel injection quantity in an estimated quantity.

10. An air-fuel ratio control apparatus for internal combustion engines as set forth in claim 6, wherein:

the state-of-load determining means is means for detecting the state of load in correspondence with a temperature of an exhaust gas which is exhausted from the internal combustion engine.

11. An air-fuel ratio control apparatus for internal combustion engines as set forth in claim 6, wherein:

the level of the load is a temperature of an exhaust gas which is exhausted from the internal combustion engine.

* * * * *